United States Patent [19]

Vokaty

[11] Patent Number: 4,645,104

[45] Date of Patent: Feb. 24, 1987

[54] TOOL HOLDER

[76] Inventor: Joseph L. Vokaty, 2920 Glenview Rd., Glenview, Ill. 60025

[21] Appl. No.: 892,873

[22] Filed: Jul. 28, 1986

Related U.S. Application Data

[63] Continuation of Ser. No. 673,000, Nov. 19, 1984, abandoned.

[51] Int. Cl.[4] ..... A45F 5/00

[52] U.S. Cl. ..... 224/253; 224/904

[58] Field of Search ..... 224/252, 253, 904, 234

[56] References Cited

U.S. PATENT DOCUMENTS

| | | | |
|---|---|---|---|
| 1,326,887 | 12/1919 | Wood | 224/904 X |
| 3,104,434 | 9/1963 | Noordhoek | 224/904 X |
| 3,156,388 | 11/1964 | Simmons . | |
| 3,265,259 | 8/1966 | Marburger | 224/253 X |
| 3,450,317 | 6/1969 | Ramer | 224/904 X |
| 3,599,847 | 8/1971 | Danielson | 224/904 X |
| 4,321,755 | 3/1982 | Illgen . | |
| 4,372,468 | 2/1983 | Harvey . | |

*Primary Examiner*—Charles E. Phillips
*Assistant Examiner*—Robert M. Petrik
*Attorney, Agent, or Firm*—Allegretti, Newitt, Witcoff & McAndrews, Ltd.

[57] ABSTRACT

A tool holder for holding a T-shaped tool which includes a tool head receiving member and a tool tail receiving member. The tool head receiving member includes an opening with a continuous surface for engaging the tool head at spaced apart points of contact for control of the tool during any jostling movement thereof. The tool tail receiving member includes a U-shaped inner surface disposed for guiding the tool head into engagement with the tool receiving member. The tool head receiving member and tool tail receiving member are spaced apart a distance for receiving the handle of the tool.

6 Claims, 8 Drawing Figures

TOOL HOLDER

This application is a continuation of application Ser. No. 673,000, filed Nov. 19, 1984, now abandoned.

BACKGROUND OF THE INVENTION

The invention relates to a hammer holder for attachment to a tradesman's belt for holding a hammer at the user's side until needed, and more particularly relates to a holder for hammers, picks and other T-shaped tools or instruments.

In building construction trades where a hammer or similar tool is carried about by a tradesman, it is desirable to provide a device for use by the user to retain the hammer on his person until needed.

Heretofore, cloth loops were sewn to the tradesman's overalls to hold a hammer. Also, conventional metal loop or ring-type holders were devised for attachment to the worker's belt. See, for example, U.S. Pat. No. 3,104,434 issued to L. H. Noordhoek on Sept. 24, 1963.

However, such ring-type holders require the hammer to be maintained at or near the heaviest portion of the tool causing the tool to rotate or slide out of the loop. Sometimes the tool will fall from the loop during active physical movement. Thus, workers tend to refrain from using such types of holders particularly where workmen will be found working below the user.

It is therefore an object of the present invention to provide an improved tool holder which serves to lock the tool into position.

It is another object of the present invention to provide a holder in which a tool may be readily holstered and secured safely, as well as be expeditiously removed.

It is another object of the present invention to provide a holster requiring the use of only one hand to both holster and remove the tool.

It is yet another object of the present invention to provide a holster which is simple in construction, strong, durable, of light weight, and which may be manufactured at low cost.

SUMMARY OF THE INVENTION

These and other objects of the invention are accomplished in a tool holder requiring a double action for insertion and removal of the tool so as to prevent accidental dislodgement of the tool. The double actions require the use of only one hand to holster and draw the tool.

A tool head receiving member and a tool tail receiving member are secured in a spaced apart relationship onto a base supporting structure. The tool head receiving member includes engagement contacting surfaces for confining the movement of the tool once locked into position. The tail receiving member is U-shaped in configuration, providing guide surfaces for aiding insertion of the tool head.

DESCRIPTION OF THE PREFERRED EMBODIMENT

Figure 1:
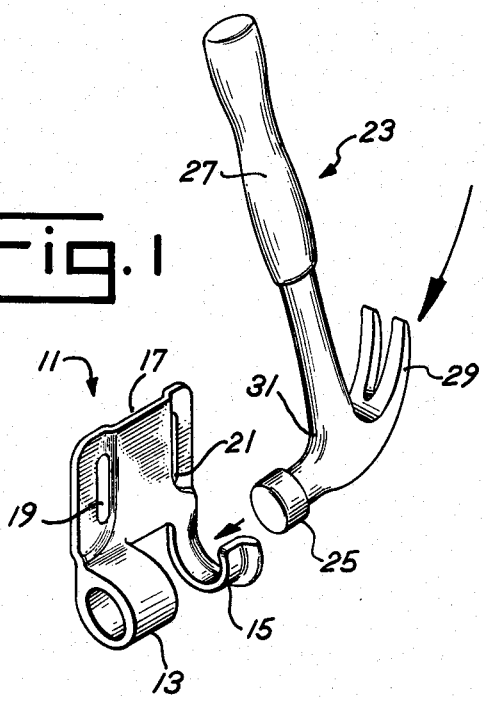
FIG. 1 is a perspective view of a tool holder embodiment of the invention, illustrating movement of the tool into the holder during a first holstering action.

Referring to FIG. 1, a tool holder 11 includes a generally cylindrical tool head receiving member 13 and a generally U-shaped tail receiving member 15. Receiving members 13, 15 are spaced apart and secured to a supporting member 17. Supporting member 17 includes a pair of vertical slots 19, 21 for receiving a tradesman's belt for securing the tool holder to the tradesman.

As shown in FIG. 1, a hammer 23 is swung in a pendulum motion in a first plane, driving the head 25 of the hammer into head receiving member 13. Tail receiving member 15 serves to guide head 25 as the hammer is swung into the tool holder.

Figure 2:
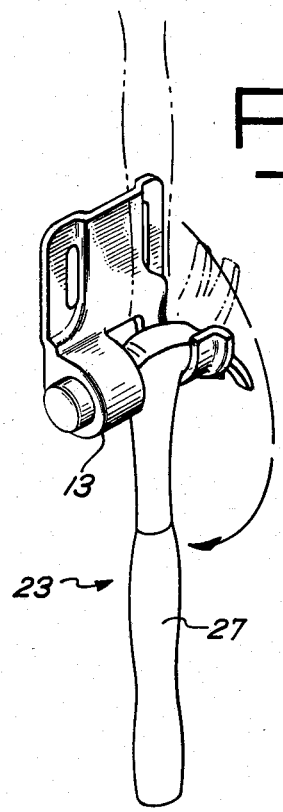
FIG. 2 is a perspective view of the tool holder of FIG. 1 showing movement of the tool into the holder during a second holstering action.

As shown in FIG. 2, after hammer 23 is swung into head receiving member 13, handle 27 of the hammer is rotated downward in a second plane perpendicular to the first plane of the swinging motion of FIG. 1. The rotation of the hammer downward locks the hammer 23 into holder 11.

Figure 3:
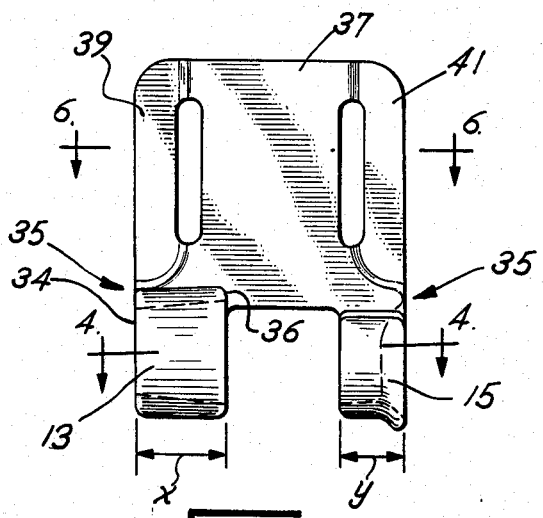
FIG. 3 is a front view of the tool holder of FIG. 1.
Figure 5:
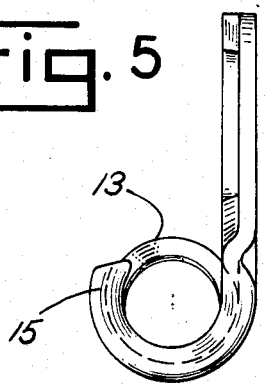
FIG. 5 is a side view of the holder of FIG. 1.
Figure 4:
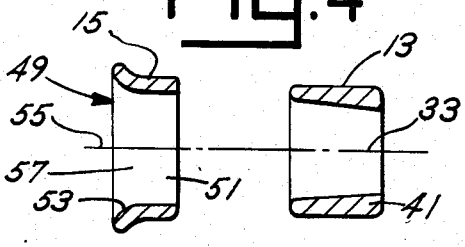
FIG. 4 is a cross sectional view of the tool holder of FIG. 1 taken through line 4—4 of FIG. 3.

As shown in FIGS. 3, 4 and 5, head receiving member 13 is a hollow, substantially cylindrically shaped member having a length X to provide a substantially conical inside surface 33 for confining hammer head 25 during jostling motion of the hammer relative to the holder. As the carpenter walks about and engages in active movements, the hammer will jostle within holder 11. Inside surface 33 of the head receiving member 13 is tapered toward its front end 34 in a conical fashion to provide an expanded target area at the inner side edge 36 for placing the hammer into the head receiving member 13 and a reduced area at the front end 34 for confining the movement of the hammer once locked in place. As will suggest itself, inside surface 33 may be substantially cylindrical in its configuration.

Receiving member 13 is secured to supporting member 17 along its bottom area 35 so as to depend subjacent from the supporting member. Member 13 extends to the front side only of supporting member 17 for maintaining the backside of holder 11 free to fit against the worker's body.

Figure 6:
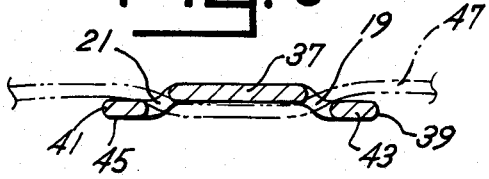
FIG. 6 is a cross sectional view of the tool holder of FIG. 1, taken through line 6—6 of FIG. 3.

The supporting member 17 is formed with a central area 37 and two side areas 39, 41. As shown in FIG. 6, central area 37 is offset to the front of side areas 39, 41, providing two flat back surfaces 43, 45 which engage the tradesman's body. Vertical slots 19, 21 are formed in the area between the central area 37 and side areas 39, 41 to permit the tradesman's belt 47 to loop behind the central area as shown in FIG. 6. Of course, the shape of supporting member 17 may be any comparable configuration, such as curved, circular, triangular, rectangular, elliptical and others.

Referring again to FIGS. 3, 4 and 5, tail receiving member 15 is U-shaped in configuration and is of a length "y" to provide an inner surface 49 for supporting and guiding the hammer. Inside surface 49 includes a generally cylindrical shaped surface 51 which leads into a flared surface 53. Flared surface 53 serves to engage the hammer head as it proceeds off axis into the holder for guiding the hammer head along axis 55.

Tail receiving member 15 is secured to supporting member 17 along its bottom area 35 so as to depend subjacent from the supporting member. Member 15 extends to the front side only of supporting member 17.

As hammer head 25 is driven into the hollow of receiving member 13, the upper handle portion 31 (FIG. 1) strikes the inner side edge 36 (FIG. 3) at the top of member 13. This stops movement of the hammer during the first holstering action permitting the operator to proceed to rotate the hammer in the second holstering action, as shown in FIG. 2. As the hammer rotates downward, it passes between receiving members 13, 15. The head 25 of the hammer rotates within the hollow of member 13 and the claw 29 of the hammer slidingly engages the inner surface 49 of the receiving member 15 at a contact location or area 57 (FIG. 4). The particular type of hammer or T-shaped implement will dictate the particular portion of inner surface 49 upon which the implement rotates.

Figure 7:
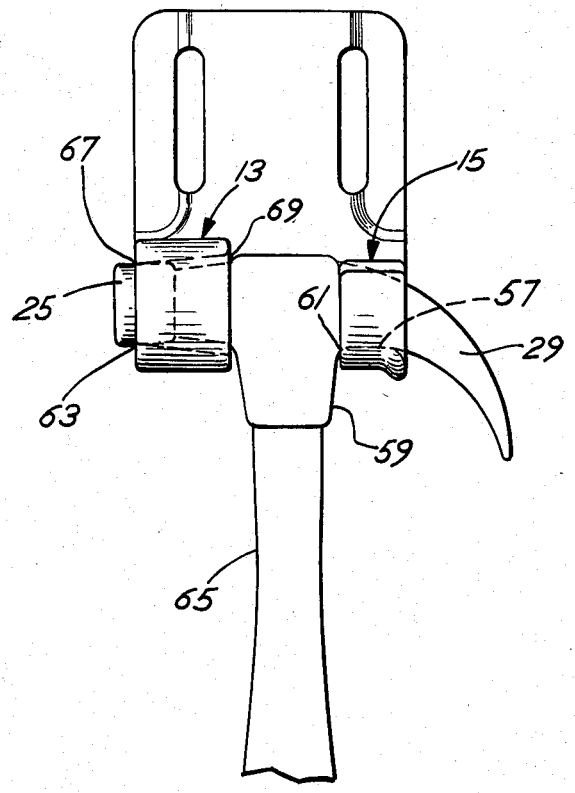
FIG. 7 is a front view of the tool holder of FIG. 1 with a hammer holstered in the holder.
Figure 8:
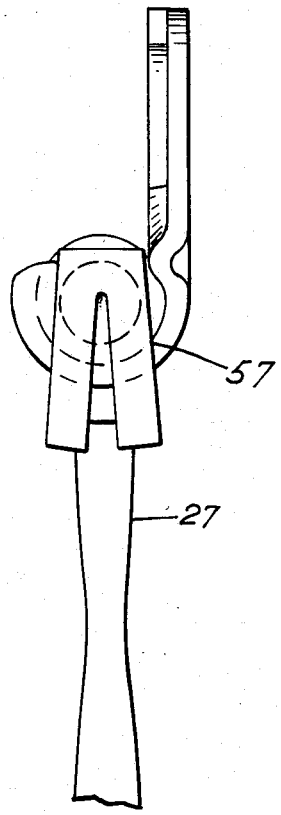
FIG. 8 is a side view of the holder of FIG. 1 with a hammer holstered in the holder.

As shown in FIGS. 7 and 8, claw 29 of the hammer seats in the U-shaped receiving member with the underside surface of the claw contacting the inner surface 49 of the receiving member at contact location 57. The area 57, in the preferred embodiment, is a curved line, as shown in FIG. 4, along which the claw slides as the hammer rotates in the second plane orthogonal to the plane of the back supporting surfaces 43, 45.

The back side 59 of the hammer (FIG. 7) abuts the inner side surface 61 of receiving member 15. With the hammer claw resting on contact points or locations 57, 61, the hammer will tend to rotate clockwise (in a plane parallel to back supporting surfaces 43, 45) due to its center of gravity, biasing head 25 downwards into contact against area 63 on the lower front portion of the inside surface 33 of receiving member 13. With the hammer in its normal rest position, as shown in FIG. 7, the hammer is tilted slightly off of vertical centerline 65. The particular type of hammer or T-shaped implement will dictate the extent that the hammer is tilted in its rest position.

A leftward rotation of handle 27 of the hammer with respect to vertical line 65 (in the plane of the drawing, FIG. 7) merely moves hammer head 25 upward into contact against area 67 on the upper front portion of the inside surface 33 of receiving member 13 as the hammer pivots generally on contact area 57.

The shape of claw 29 together with the weight of the hammer tends to bias the back side 59 of the hammer against surface 61 of the tail receiving member. Thus, leftward movement of the hammer handle (in the plane of the drawing, FIG. 7) will move the hammer head between contact points 63, 67 with gravity biasing the head toward point 63 for resting the hammer in the position shown in FIG. 7. Thus, the hammer is retained in the holder despite a leftward jostling of the handle.

A rightward rotation of handle 27 of the hammer relative to vertical line 65 (in the plane of the drawing of FIG. 7), causes head 25 to remain in contact with the inside surface of receiving member 13 at location 63, about which the hammer pivots, causing the top of the hammer to contact against area 69 of the upper rear portion of the inside surface of receiving member 13. During this pivoting about point 63, claw 29 leaves contact with area 57 until the top of the hammer contacts area 69. However, side surface 59 of the hammer makes sliding contact with surface 61 as the hammer pivots upward.

The left-right movement of handle 27 relative to vertical 65 serves to drive the hammer head between contact surfaces 63, 67 and between contact surfaces 57, 69 while maintaining sliding contact on front surface 61 of receiving member 15. Thus, with any jostling movement to handle 27, the hammer head is retained in receiving members 13, 15 by the contact points 63, 67, 69 on receiving member 13 and contact points 57, 61 on receiving member 15.

Any jostling movement in an orthogonal plane (to the plane of the drawing of FIG. 7) merely serves to rotate the hammer head about the axis of receiving members 13, 15, maintaining contact at points 63, 61, 57.

As shown in FIGS. 3, 4, 5 and 7, the conical shape of the inside surface 33 of the head receiving member 13 has two advantages. First, the head receiving member 13 retains an expanded target area at the inner side edge 36 for insertion of the hammer or tool into the head receiving member 13. Second, the reduced area at the front end 34 provides greater restraint to the movement of the hammer head 25 during the jostling of the handle 27 by reducing the movement of the hammer head 25 between contact surfaces 63 and 67.

The external width X of member 13 serves to establish the distance between contact points 67, 69. Likewise, the external width Y and the point at which cylindrical surface 51 leads into flared surface 53 serves to establish the distance between contact locations 57, 61.

It should be understood, of course, that the foregoing disclosure relates to a preferred embodiment of the invention and that other modifications or alterations may be made therein without departing from the spirit or scope of the invention as set forth in the appended claims.

What is claimed is:

1. A tool holder for holding a T-shaped tool having a tool head, a tool tail and a handle, comprising:

a base supporting member;

a tool head receiving member secured subjacent to said base support member, said receiving member having a barrel for receiving a substantial amount of the tool head, said barrel having an inside continuous surface for engaging the tool head at axially spaced apart points of contact on said continuous surface during jostling movement of the tool relative to said base supporting member; and a tool tail receiving member secured subjacent to said base supporting member and having a U-shaped inner surface disposed for guiding the tool head into engagement with said inside continuous surface of said tool head receiving member and for supporting the tool tail during tool head engagement;

said tool receiving members secured to said base supporting member in a spaced apart relationship of a distance for receiving the tool handle between said receiving members.

2. A tool holder according to claim 1 wherein said tool head receiving member has first and second ends, said first end aligned adjacent to the spaced area between said tool receiving members, and said inside surface of said tool head receiving member is conical with said opening formed by said inside surface greatest at said first end of said tool head receiving member.

3. A tool holder according to claim 1 wherein said inside surface of said tool head receiving member is cylindrical.

4. A tool holder according to claim 1 wherein said tail receiving member includes a flared surface connected contiguous to said U-shaped inner surface.

5. The tool holder according to claim 1 wherein said base support member includes a pair of belt receiving slots spaced apart for permitting attachment of the holder to a user's belt.

6. A tool holder according to claim 1 wherein said tool receiving member provides points of contact with the tool tail during jostling movement of the tool relative to said base supporting member during tool head engagement with said inside continuous surface of said tool head receiving member.

* * * * *